US009308563B2

(12) United States Patent
Ota

(10) Patent No.: US 9,308,563 B2
(45) Date of Patent: Apr. 12, 2016

(54) MANUFACTURING METHOD OF HOT-ROLLED STEEL SHEET

(75) Inventor: Takeshi Ota, Kashima (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 877 days.

(21) Appl. No.: 13/466,478

(22) Filed: May 8, 2012

(65) Prior Publication Data

US 2012/0216924 A1 Aug. 30, 2012

Related U.S. Application Data

(63) Continuation of application No. PCT/JP2010/070614, filed on Nov. 18, 2010.

(30) Foreign Application Priority Data

Nov. 24, 2009 (JP) ..... 2009-266774

(51) Int. Cl.
*B21C 51/00* (2006.01)
*B21B 37/76* (2006.01)
*B21B 38/00* (2006.01)

(52) U.S. Cl.
CPC ..... *B21C 51/00* (2013.01); *B21B 37/76* (2013.01); *B21B 38/006* (2013.01); *B21B 2261/20* (2013.01)

(58) Field of Classification Search
CPC ..... B21C 51/00; B21B 37/76; C21D 8/0226
USPC ..... 72/16.2
IPC ..... B21B 37/74,37/76; C21D 8/0226
See application file for complete search history.

(56) References Cited

U.S. PATENT DOCUMENTS 4,274,273 A * 6/1981 Fapiano et al. ..... 72/8.5

FOREIGN PATENT DOCUMENTS

| | | |
|---|---|---|
| JP | 61-056722 | 3/1986 |
| JP | 03-069974 | 3/1991 |
| JP | 2003-185501 | 7/2003 |
| JP | 2005-024303 | 1/2005 |
| JP | 2006-010130 | 1/2006 |
| JP | 2006-035233 | 2/2006 |
| JP | 4029871 | 1/2008 |
| WO | 95/05904 | 3/1995 |

* cited by examiner

*Primary Examiner* — Weiping Zhu
(74) *Attorney, Agent, or Firm* — Clark & Brody

(57) ABSTRACT

The present invention provide a manufacturing method of a hot-rolled steel sheet capable of providing a target temperature for temperature of a rolled material in a final stand in a row of hot finishing mills, even when disposing a cooling device capable of cooling from inside the row of hot finishing mills. The method comprises: rapidly cooling the rolled material by spraying cooling water at inside of the final stand on a lower process side of the final stand in the row of hot finishing mills; obtaining an entry-side surface temperature of the rolled material on an entry side of the final stand; and calculating a target surface temperature on the entry side of the final stand, from a target surface temperature on the exit side of the final stand, based on generated heat and temperature reductions by contact of work rolls with the rolled material and by air cooling.

11 Claims, 7 Drawing Sheets

MANUFACTURING METHOD OF HOT-ROLLED STEEL SHEET

TECHNICAL FIELD

The present invention relates to a manufacturing method of a hot-rolled sheet and a manufacturing apparatus of a hot-rolled steel sheet. More specifically, it relates to a manufacturing method of a hot-rolled sheet and a manufacturing apparatus of a hot-rolled steel sheet capable of appropriately controlling a temperature of a rolled material in manufacturing a hot-rolled steel sheet by spraying cooling water at the rolled material having a high temperature immediately after being rolled in a hot finishing mill to water-cool it.

BACKGROUND ART

A steel material used for automobiles, structural materials, and the like is required to be excellent in such mechanical properties as strength, workability, and toughness. In order to improve these mechanical properties comprehensively, it is effective to refine the structure of the steel material. To this end, a number of manufacturing methods for obtaining a steel material with a fine structure have been sought. Further, by refining the structure, it is possible to obtain a high-strength hot-rolled steel sheet having excellent mechanical properties even if the amount of alloy elements added is reduced.

As a method for refining the structure of a steel material, it is known that a large rolling reduction is carried out especially in the later stage of a row of hot finishing mills to refine austenite grains and to increase rolling strains in a rolled material, thereby obtaining fine ferrite grains after rolling. Further, in view of inhibiting recrystallization and recovery of the austenite grains and facilitating the ferrite transformation, it is effective to cool the rolled material to a temperature from 600° C. to 750° C. as quickly as possible after rolling. That is, subsequent to hot finish rolling, it is effective to arrange a cooling device capable of cooling more quickly than ever before to thereby rapidly cool the rolled material after the rolling. And in rapidly cooling the post-rolled material in this way, it is effective to increase a volume of cooling water per unit area sprayed over the steel sheet, that is, to increase a water flow density in order to enhance a cooling capability. And this cooling method is hereinafter called immediate rapid-cooling.

Now, in manufacturing a hot-rolled steel sheet, it is important to control a temperature of a rolled material as accurately as possible so that a desired quality thereof can be finally obtained. For that purpose, a temperature measuring device is disposed in each location in a manufacturing apparatus of a hot-rolled steel sheet in order to know the temperature of the rolled material at each of those locations. In this viewpoint, a temperature measuring device is also disposed on an exit side of a row of hot finishing mills; thereby the temperature of the rolled material at a time of completion of finish rolling can be obtained. Since there is a cooling step afterwards, the temperature on the exit side of the finishing mill is important in determining a final target temperature and a degree of cooling needed to attain this.

However, when rapid cooling by water is performed immediately after finish rolling as described above, it is impossible to measure the temperature of the rolled material on the exit side of the finishing mill. To solve such a problem, Patent Document 1, for example, discloses a means to obtaining the temperature on the exit side of the rolling mill. Patent Document 1 describes that conventionally it has been impossible, because of cooling water, to measure the temperature on the exit side of the rolling mill by using a thermometer disposed on an exit side of a final stand in a row of hot finishing mills, and therefore the temperature of the rolled material is measured on an entry side of the final stand in the row of hot finishing mills.

CITATION LIST

Patent Literature

Patent Document 1: Japanese Patent Application Laid-Open No. 61-56722

SUMMARY OF INVENTION

Problems to be Solved by the Invention

According to Patent Document 1, the temperature on the entry side of the final stand which corresponds to the temperature on the exit side of the final stand is described; however, it is not shown how this is calculated, thus making it impossible to perform the temperature control based on the temperature on the entry side of the final stand.

Accordingly, in view of the above problems, an object of the present invention is to provide, in a manufacturing line of a hot-rolled steel sheet, a manufacturing method of a hot-rolled steel sheet and a manufacturing apparatus of a hot-rolled steel sheet which are capable of providing a target temperature for the temperature of the rolled material in the final stand of the row of hot finishing mills, even when a cooling device capable of cooling from inside the finishing mill is disposed.

Means for Solving the Problems

The present invention will be described below. Although the reference symbols given in accompanying drawings are shown in parentheses for the purpose of easy understanding, the invention is not limited to an embodiment shown in the drawings.

A first aspect of the present invention is a manufacturing method of a hot-rolled steel sheet, wherein cooling water is sprayed at an inside of a final stand on a lower process side of the final stand in a row (11) of hot finishing mills, to rapidly cool a rolled material; a surface temperature of the rolled material is measured on an entry side of the final stand, to obtain an entry-side surface temperature; and an entry-side target surface temperature, which is a target surface temperature of the rolled material at the measurement position of the entry-side surface temperature, is calculated from an exit-side target surface temperature, which is a target surface temperature of the rolled material on an exit side of the final stand, based on: a temperature increase by a heat generated by rolling processing in the final stand; a temperature reduction by contact of a work roll in the final stand with the rolled material; and a temperature reduction by air cooling in transportation from the measurement position of the entry-side surface temperature to the work roll of the final stand.

A second aspect of the present invention is the manufacturing method of a hot-rolled steel sheet according to the first aspect, wherein in calculating the entry-side target surface temperature, changes in the surface temperature of the rolled material in a rolling direction are included as an element.

A third aspect of the present invention is the manufacturing method of a hot-rolled steel sheet according to the first or second aspect, wherein in a case when rolling by the row (11) of hot finishing mills is carried out by a rolling method to change a rolling reduction of the rolling mills during the rolling, sheet thickness changes and changes in a friction coefficient between the rolled material and the work roll due to the rolling reduction changes are also included as elements in calculating the entry-side target surface temperature.

A fourth aspect of the present invention is the manufacturing method of a hot-rolled steel sheet according to any one of the first to third aspects, wherein the rolled material is cooled by cooling water also in the entry side of the final stand; and in calculating the entry-side target surface temperature, the temperature reduction by water cooling at a time of transportation from the measurement position of the entry-side surface temperature to the work roll of the final stand is also included as an element.

A fifth aspect of the present invention is the manufacturing method of a hot rolled steel sheet according any one of the first to fourth aspects, wherein a measuring device of the entry-side surface temperature is a thermometer disposed at a position opposing to the surface of the rolled material; and as to the thermometer, a plurality of the thermometers are disposed in a sheet width direction of the rolled material, or one width direction thermometer is disposed.

A sixth aspect of the present invention is the manufacturing method of a hot-rolled steel sheet according to anyone of the first to fifth aspects, wherein the measuring device of the entry-side surface temperature is a water column thermometer comprising: a radiation thermometer disposed at the position opposing to the surface of the rolled material; and a water column forming device for forming a watercourse as a light waveguide between the rolled material and the radiation thermometer.

A seventh aspect of the present invention is the manufacturing method of a hot-rolled steel sheet according to any one of the first to sixth aspects, wherein the entry-side target surface temperature and the entry-side surface temperature are compared based on the calculated entry-side target surface temperature and the measured entry-side surface temperature; and a command is sent to at least one of a coilbox, rough bar heater, descaler, and between-stand cooling device such that the entry-side surface temperature becomes the entry-side target surface temperature.

An eight aspect of the present invention is the manufacturing method of a hot-rolled steel sheet according to any one of the first to seventh aspects, wherein when rolling is carried out without performing the rapid cooling, the surface temperature of the rolled material is measured in a zone supposed to be rapidly coolable or immediately after the zone to obtain the surface temperature after rolling.

A ninth aspect of the present invention is the manufacturing method of a hot-rolled steel sheet according to the eighth aspect, wherein the surface temperature of the rolled material on the exit side of the final stand is calculated based on the measured entry-side surface temperature and the post-rolling surface temperature; the calculated surface temperature is compared with the surface temperature of the rolled material on the exit side of the final stand obtained by the calculation process of the entry-side target surface temperature; and the calculation of the entry-side target surface temperature is modified based on the error.

A tenth aspect of the present invention is the manufacturing method of a hot-rolled steel sheet, wherein cooling water is sprayed at an inside of a final stand on a lower process side of the final stand in a row (11) of hot finishing mills, to rapidly cool a rolled material; a surface temperature of the rolled material is measured on an entry side of the final stand, to obtain an entry-side surface temperature; a prescribed entry-side target surface temperature and the measured entry-side surface temperature are compared; and a command is sent to at least one of a coilbox, rough bar heater, descaler, and between-stand cooling device such that the measured entry-side surface temperature becomes the entry-side target surface temperature.

An eleventh aspect of the present invention is a manufacturing apparatus (10) of a hot-rolled steel sheet comprising: a row (11) of hot finishing mills; an immediate rapid-cooling device (20), which is disposed on a lower process side of a final stand in the row of hot finishing mills, and at least a part of which is disposed inside the final stand so as to be capable of spraying cooling water; a device (40) for measuring a rolled material temperature, which is arranged in a manner capable of measuring a surface temperature of the rolled material on an entry side of the final stand; and a target temperature arithmetic device (51), which calculates an entry-side target surface temperature being a target surface temperature of the rolled material at a measurement position of the entry-side surface temperature, from an exit-side target surface temperature being a target surface temperature of the rolled material on an exit side of the final stand, based on: a temperature increase by a heat generated by rolling processing in the final stand; a temperature reduction by contact of a work roll of the final stand with the rolled material; and a temperature reduction by air cooling in transportation from the measurement position of the entry-side surface temperature to the work roll of the final stand.

A twelfth aspect of the present invention is the manufacturing apparatus (10) of a hot-rolled steel sheet according to the eleventh aspect, wherein the target temperature arithmetic device (51) is capable of carrying out a calculation including as an element, changes in the surface temperature of the rolled material in a rolling direction, in calculating the entry-side target surface temperature.

A thirteenth aspect of the present invention is the manufacturing apparatus (10) of a hot-rolled steel sheet according to the eleventh or twelfth aspect, wherein in the row (11) of hot finishing mills, a rolling reduction can be changed during rolling; and in a case when rolling is carried out by a rolling method to change the rolling reduction in the rolling mills during the rolling, the target temperature arithmetic device (51) is capable of carrying out a calculation including as elements, sheet thickness changes and changes in a friction coefficient between the rolled material and the work roll due to the rolling reduction changes, in calculating the entry-side target surface temperature.

A fourteenth aspect of the present invention is the manufacturing apparatus of a hot-rolled steel sheet according to any one of the eleventh to thirteenth aspects, wherein a cooling device (35) is also arranged on the entry side of the final stand (11*g*) in a manner capable of spraying cooling water at the rolled material; and the target temperature arithmetic device (51) is capable of calculating the temperature reduction of the rolled material caused by the cooling device which is arranged on the entry side of the final stand, in calculating the entry-side target surface temperature.

A fifteenth aspect of the present invention is the manufacturing apparatus (10) of a hot-rolled steel sheet according to any one the eleventh to fourteenth aspects, wherein the device (40) for measuring a rolled material temperature is a thermometer disposed at a position opposing to the surface of the rolled material; and as to the thermometer, a plurality of the thermometers are disposed in a sheet width direction of the rolled material, or one width direction thermometer is disposed.

A sixteenth aspect of the present invention is the manufacturing apparatus (10) of a hot-rolled steel sheet according to any one of the eleventh to fifteenth aspects, wherein the device (40) for measuring a rolled material temperature is a water column thermometer comprising: a radiation thermometer disposed at the position opposing to the surface of the rolled material; and a water column forming device for forming a watercourse as a light waveguide between the rolled material and the radiation thermometer.

A seventeenth aspect of the present invention is the manufacturing apparatus (10) of a hot-rolled steel sheet according to any one of the eleventh to sixteenth aspects, further comprising at least one of a coilbox (15), rough bar heater (16), descaler (17), and between-stand cooling device (35), wherein the target temperature arithmetic device (51) is capable of controlling at least one of the comprised coilbox (15), rough bar heater (16), descaler (17), and between-stand cooling device (35).

An eighteenth aspect of the present invention is the manufacturing apparatus (110) of a hot-rolled steel sheet according to any one of the eleventh to seventeenth aspects, wherein a device for measuring a temperature of a rolled material is disposed inside the immediate rapid-cooling device (20) or on an exit side of the immediate rapid-cooling device.

A nineteenth aspect of the present invention is the manufacturing apparatus (110) of a hot-rolled steel sheet according to the eighteenth aspect, wherein the target temperature arithmetic device (51) is capable of: calculating the surface temperature of the rolled material on the exit side of the final stand (11*g*) based on the results of the temperature measurement by the device (40) for measuring a rolled material temperature and the device (140) for measuring a temperature of a rolled material which device is disposed inside the immediate rapid-cooling device (20) or on the exit side of the immediate rapid-cooling device; and also comparing the calculated surface temperature with the surface temperature of the rolled material on the exit side of the final stand obtained by the calculation process of the entry-side target surface temperature to modify the calculation of the entry-side target surface temperature based on the error.

Effects of the Invention

According to the manufacturing method of a hot-rolled steel sheet and the manufacturing apparatus of a hot-rolled steel sheet of the present invention, even when a cooling device capable of cooling from inside the row of hot finishing mills is disposed on the exit side of the row of hot finishing mills, it is possible to provide a target temperature for the temperature of the rolled material in the final stand of the row of hot finishing mills. Further, by providing a device for controlling the given target temperature, it is also possible to control the temperature of the rolled material.

MODES FOR CARRYING OUT THE INVENTION

The functions and benefits of the present invention described above will be apparent from the following modes for carrying out the invention. The present invention will be described based on the embodiments shown in the accompanying drawings. However, the invention is not limited to these embodiments.

Figure 1:
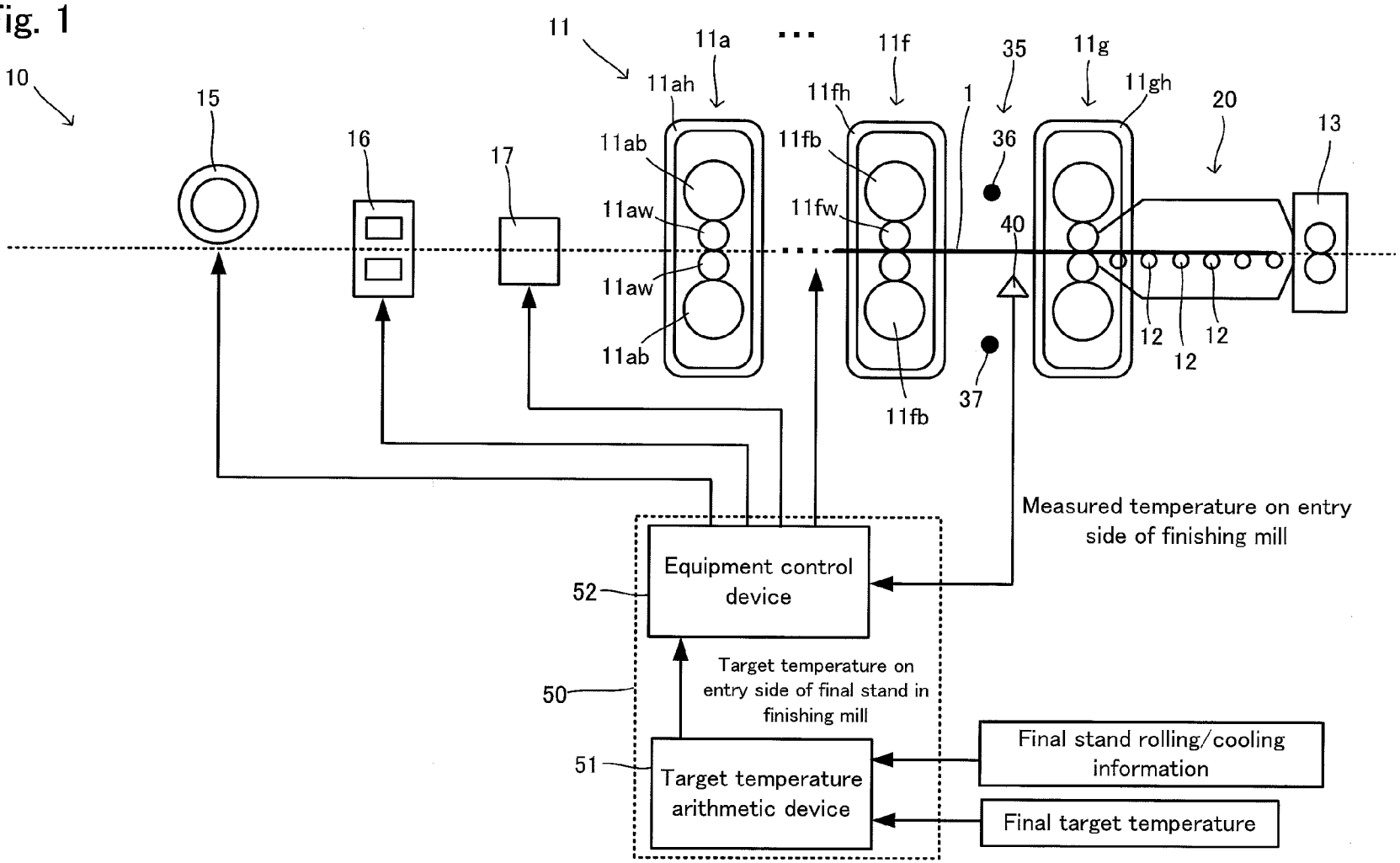
FIG. 1 is a schematic view showing a part of a manufacturing apparatus of a hot-rolled steel sheet according to a first embodiment.

FIG. 1 is a conceptual view illustrating a manufacturing apparatus 10 of a hot-rolled steel sheet according to a first embodiment (hereinafter, sometimes referred to as a "manufacturing apparatus 10"). In FIG. 1, a rolled material 1 is transported from a left on the sheet of paper (upstream side, upper process side) to a right (downstream side, lower process side); and a top-to-bottom direction on the sheet of paper is a vertical direction. Here, a pass line is indicated by a dashed line. A direction from the upstream side (the upper process side) to the downstream side (the lower process side) may be referred to as a sheet passing direction; and a direction of a sheet width of the passing rolled material, which is orthogonal to the sheet passing direction, may be referred to as a sheet width direction of a rolled material. Further, repeating reference symbols may be omitted in the below descriptions of the drawings for the purpose of easy viewing.

As shown in FIG. 1, the manufacturing apparatus 10 comprises: a coilbox 15; a rough bar heater 16; a descaler 17; a row 11 of hot finishing mills; transporting rolls 12, 12, . . . ; a pinch roller 13; and an immediate rapid-cooling device 20. Further, the manufacturing apparatus 10 comprises: a between-stand cooling device 35 between each stand in the row 11 of hot finishing mills; and a device 40 for measuring a rolled material temperature, on the entry side of the final stand 11*g*. Additionally, the manufacturing apparatus 10 comprises a temperature control device 50.

Furthermore, a heating furnace, a row of rough rolling mills, and the like, the figures and descriptions of which are omitted, are arranged on the upper process side of the coilbox 15; on the other hand, a hot-run cooling device and a coiling device are arranged on the lower process side of the pinch roller 13.

A hot-rolled steel sheet is generally manufactured in the following way. A rough bar which has been taken from the heating furnace and has been rolled in the rough rolling mill to have a predetermined thickness is rolled continuously in the row 11 of hot finishing mills to have a predetermined thickness, with the temperature controlled. After that, the rolled material is rapidly cooled in the immediate rapid-cooling device 20. Then, the rolled material passes through the pinch roller 13, and is cooled by the hot-run cooling device to a predetermined coiling temperature to be coiled by the coiling device. Detailed descriptions of the manufacturing method will be given later.

Figure 2:
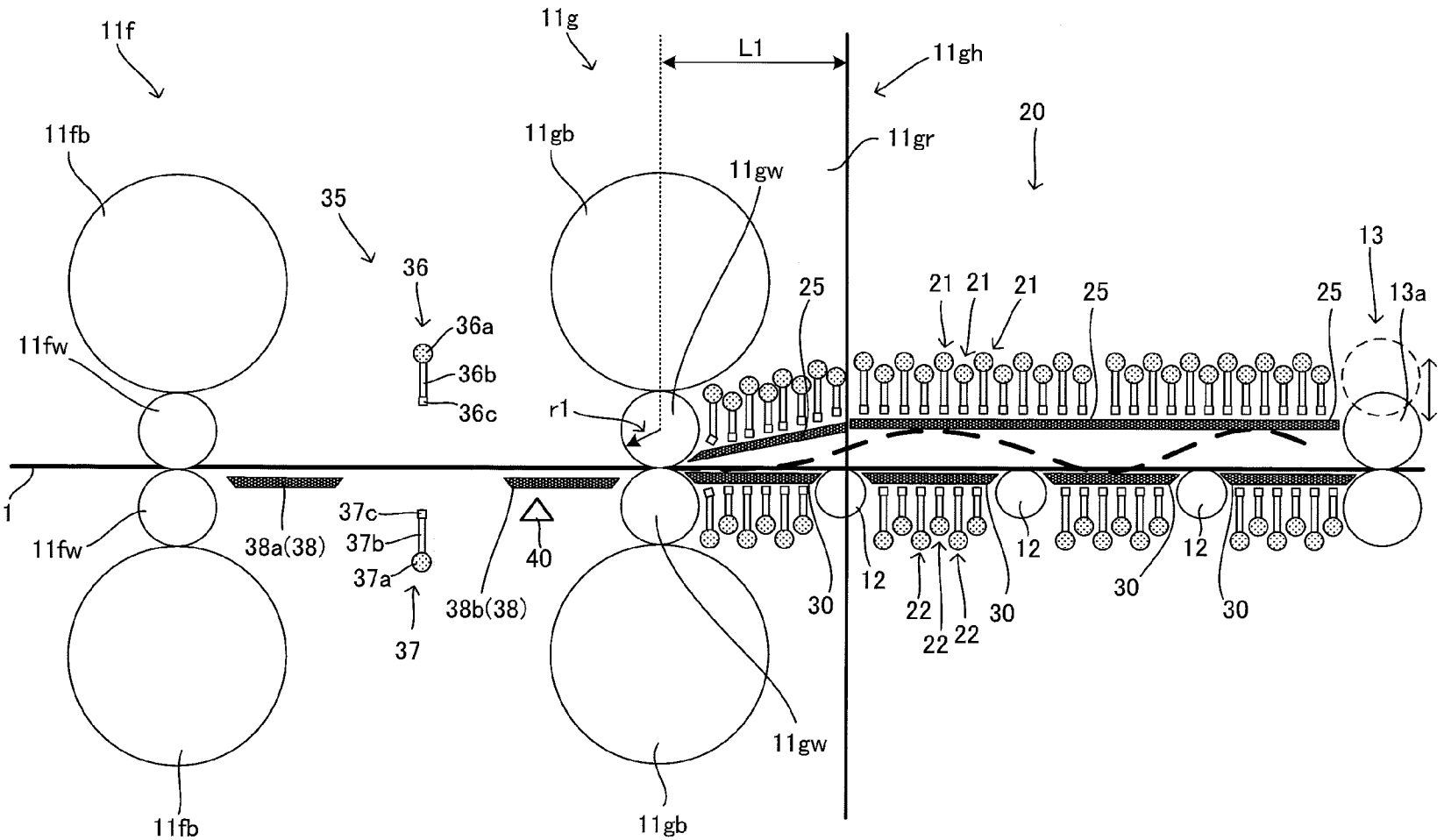
FIG. 2 is an enlarged view focusing, in FIG. 1, on an area between a final stand and a stand positioned therebefore and on an area where an immediate rapid-cooling device is disposed.
Figure 3:
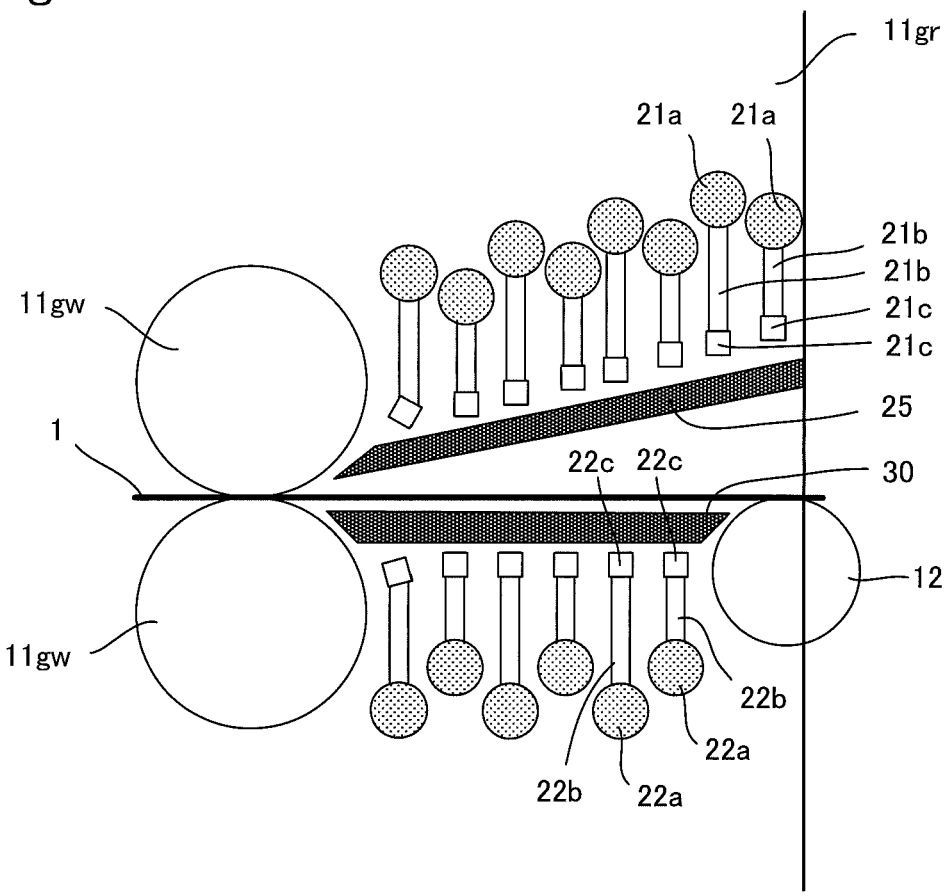
FIG. 3 is a view focusing on an area of the immediate rapid-cooling device, the area being disposed inside the final stand.

Hereinafter, the manufacturing apparatus 10 will be described in detail. FIG. 2 is an enlarged view of an area in FIG. 1, the area ranging from the stand 11*f* and final stand 11*g* in the row 11 of hot finishing mills to the immediate rapid-cooling device 20 and the pinch roller 13. FIG. 3 further focuses on the exit side of the final stand 11*g*.

In the row 11 of hot finishing mills, seven rolling mills 11*a*, . . . , 11*f*, 11*g* are arranged in a row along the sheet passing direction. Each of the rolling mills 11*a*, . . . , 11*f*, 11*g* forms each stand, and rolling conditions such as a rolling reduction are set in each of the rolling mills to enable the rolled material to meet conditions for thickness, mechanical properties, surface quality, and the like which are required in a final product. Herein, a rolling reduction in each stand is set such that a rolled material to be manufactured can meet a required performance; and in view of carrying out a large rolling reduction to refine austenite grains and to increase rolling strains in the steel sheet and obtaining fine ferrite grains after rolling, the rolling reduction is preferably as large as possible in the final stand 11*g*.

The rolling mill in each stand comprises: a pair of work rolls 11*aw*, 11*aw*, . . . , 11*fw*, 11*fw*, 11*gw*, 11*gw* which actually sandwiches the rolled material therebetween to reduce a thickness thereof; and a pair of backup rolls 11*ab*, 11*ab*, . . . , 11*fb*, 11*fb*, 11*gb*, 11*gb* which is disposed in a manner contacting the outer periphery thereof with the outer periphery of the work rolls. Further, the rolling mill in each stand comprises a housing 11*ah*, . . . , 11*fh*, 11*gh* which includes the above work rolls and backup rolls therein and forms an outer shell of the rolling mill to support the rolling rolls. The housing comprises standing side members 11*gr*, 11*gr* which are arranged to stand in an opposing manner to form a pair. And the standing side members 11*gr*, 11*gr* are arranged to stand in a manner sandwiching, between the pair thereof, the passing rolled material 1 in the sheet width direction of the rolled material.

Herein, a distance shown by L1 in FIG. 2 between the center of the rotary shaft of the work roll 11*gw* in the final stand 11*g* and the end face on the lower process side of the standing side member 11*gr* of the housing is larger than the radius r1 of the work roll 11*gw*. Therefore, as described below, a part of the immediate rapid-cooling device 20 can be disposed in an area corresponding to the space L1-r1. That is, it is possible to dispose a part of the immediate rapid-cooling device 20 in such a manner as being incorporated into the housing 11*gh*.

The transporting rolls 12, 12, . . . are a group of transporting rolls which transport the rolled material 1 in the sheet passing direction.

The pinch roller 13 also serves to remove water, and is arranged on the lower process side of the immediate rapid-cooling device 20. This can prevent cooling water sprayed in the immediate rapid-cooling device 20 from flowing out to the lower process side of the rolled material 1. Furthermore, this can prevent the rolled material 1 from ruffling in the immediate rapid-cooling device 20, and can improve a passing ability of the rolled material 1 especially at a time before the top portion of the rolled material 1 is drawn into the coiling device. Here, an upper-side roll 13*a* of the pinch roller 13 is configured to be movable up and down, as shown in FIG. 2.

The immediate rapid-cooling device 20 comprises: upper surface water supplying devices 21, 21, . . . ; lower surface water supplying devices 22, 22, . . . ; upper surface guides 25, 25, . . . ; and lower surface guides 30, 30, . . . .

The upper surface water supplying devices 21, 21, . . . are devices to supply cooling water to an upper surface side of the rolled material 1. The upper surface water supplying devices 21, 21, . . . comprise: cooling headers 21*a*, 21*a*, . . . ; conduits 21*b*, 21*b*, . . . provided, in a row in a plural form, to each of the cooling headers 21*a*, 21*a*, . . . ; and cooling nozzles 21*c*, 21*c*, . . . attached to an end portion of the conduits 21*b*, 21*b*, . . . .

The cooling header 21*a* is a pipe extending in the sheet width direction of the rolled material; and these cooling headers 21*a*, 21*a*, . . . are aligned in the sheet passing direction.

The conduits 21*b*, 21*b*, . . . are a plurality of thin pipes diverging from each cooling header 21*a*, and opening ends of the conduits are directed toward the upper surface side of the rolled material 1 (upper surface side of the pass line). A plurality of the conduits 21*b*, 21*b*, . . . are arranged in a comb-like manner along a direction of a tube length of the cooling header 21*a*, namely, in the sheet width direction of the rolled material.

Figure 4:
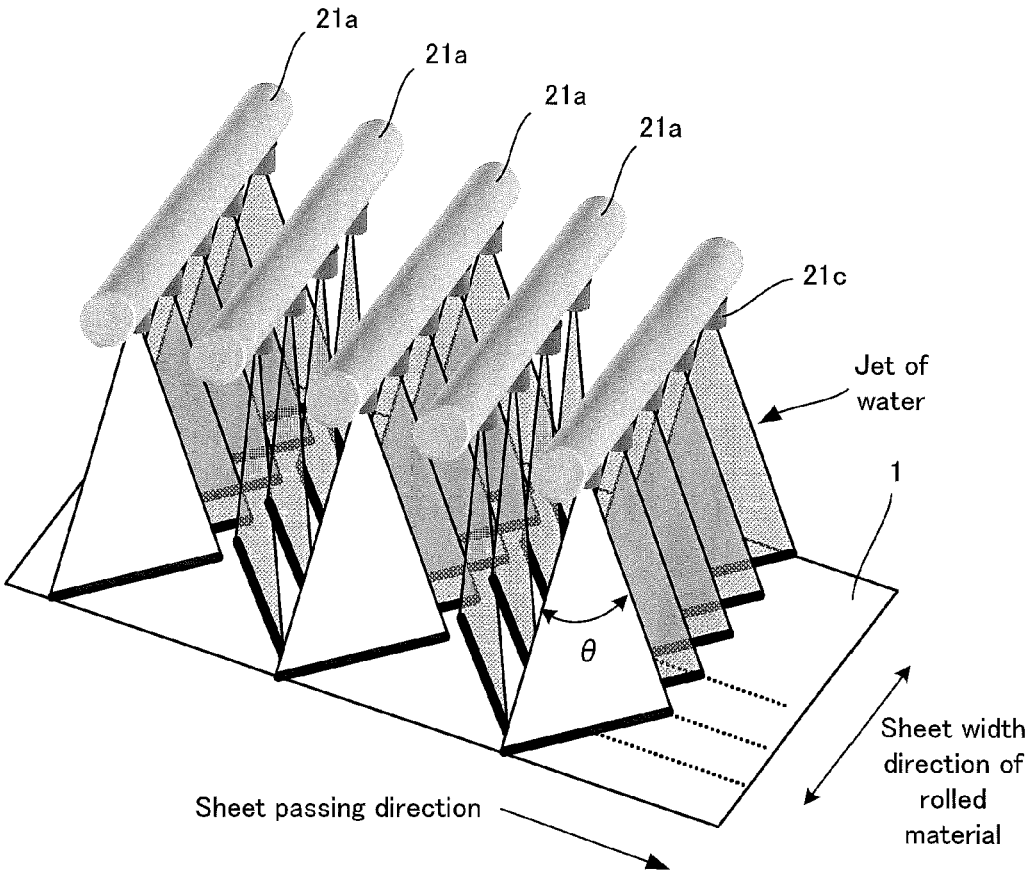
FIG. 4 is a perspective view illustrating cooling nozzles of the immediate rapid-cooling device.
Figure 5:
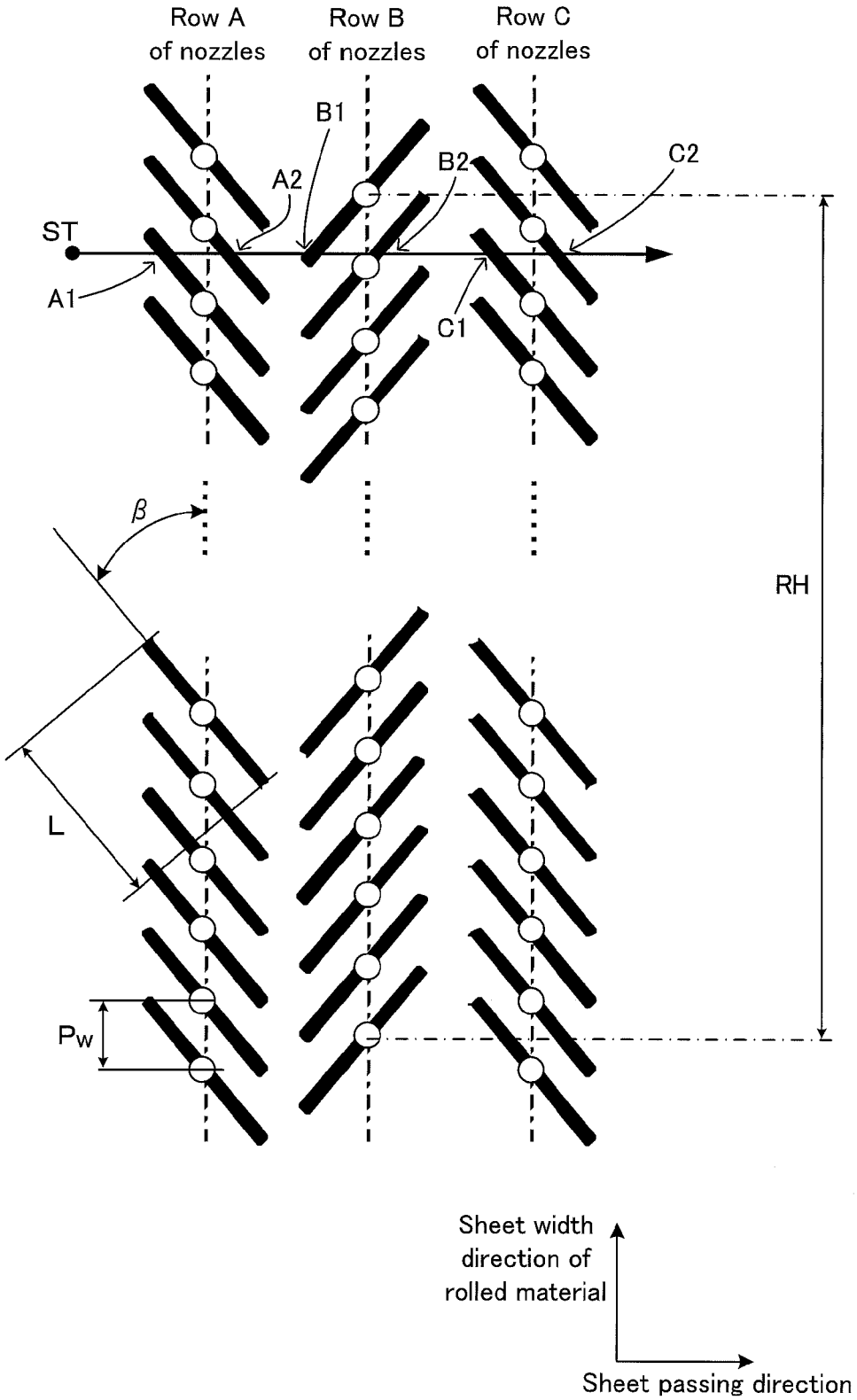
FIG. 5 is a view illustrating an arrangement of the cooling nozzles of the immediate rapid-cooling device.

An end portion of each of the conduits 21*b*, 21*b*, . . . is attached with each of the cooling nozzles 21*c*, 21*c*, . . . . The cooling nozzles 21*c*, 21*c*, . . . of the present embodiment are flat spray nozzles capable of forming a fan-like jet of cooling water (for example, a thickness of approximately 5 mm to 30 mm). FIGS. 4 and 5 schematically show the jets of cooling water to be formed on the surface of the rolled material by the cooling nozzles 21*c*, 21*c*, . . . . FIG. 4 is a perspective view. FIG. 5 is a view schematically showing a manner of an impact of the jets of cooling water on the surface of the rolled material. In FIG. 5, an open circle shows a position right below the cooling nozzles 21*c*, 21*c*, . . . . Further, a thick line schematically shows an impact position and shape of the jets of cooling water. FIGS. 4 and 5 show both the sheet passing direction and the sheet width direction of the rolled material.

As can be seen from FIGS. 4 and 5, in the embodiment, the rows of nozzles adjacent to each other are arranged such that the position of one of the rows differs from the position of its adjacent row, in the sheet width direction of the rolled material. Further, the rows of nozzles are arranged in a so-called staggered manner so that the position of one of the rows becomes the same, in the sheet width direction of the rolled material, as the position of the row which is located further next.

In the present embodiment, the cooling nozzles 21*c*, 21*c*, . . . are arranged such that an entire position on the surface of the rolled material in the sheet width direction of the rolled material can receive, at least twice, jets of cooling water coming from the same row of nozzles. That is, a point ST on which the passing rolled material is located moves along a linear arrow in FIG. 5. At this time, in such a manner as twice in a row A of nozzles (A1, A2); twice in a row B of nozzles (B1, B2); and twice in a row C of nozzles (C1, C2), in each of the rows of nozzles, the jets of water from the nozzles belonging to the row of nozzles strike twice. Thus, the cooling nozzles 21*c*, 21*c*, . . . are arranged such that the following relation is satisfied among a gap $P_w$ between the cooling nozzles 21*c*, 21*c*, . . . ; an impact width L of jets of cooling water; and a twisting angle β.

$$L=2P_w/\cos\beta$$

In the present embodiment, the number of times at which the rolled material passes through jets of cooling water is set to be twice, to which the number of times is not limited; it may be three or more times. For the purpose of uniforming a cooling capability in the sheet width direction of the rolled material, in the rows of nozzles adjacent to each other in the sheet passing direction, the cooling nozzles in one of the rows are twisted in an opposite direction from the cooling nozzles in its adjacent row.

Further, a "width of the uniformly cooled region" related to cooling of the rolled material is determined by an arrangement of the cooling nozzles. This refers to a size, in the sheet width direction of the rolled material, of the transported rolled material which can be uniformly cooled based on the characteristics of a group of cooling nozzles arranged. Specifically, the width of the uniformly cooled region is often equivalent to a width of a maximum-sized rolled material which can be manufactured by the manufacturing apparatus of a rolled material. More specifically, it is the size shown by RH in FIG. 5, for example.

Here, in the present embodiment, in the rows of nozzles adjacent to each other, the cooling nozzles 21*c*, 21*c*, . . . in one of the rows are configured, as described above, to be twisted in the opposite direction from those in its adjacent row. However, a configuration is not necessarily limited to this; all of the cooling nozzles may be twisted in the same direction. Further, a twisting angle (β as above) is not particularly limited, but may be adequately determined in view of a required cooling capability and an arrangement of equipment.

Furthermore, in the present embodiment, in view of the above benefits, the rows of nozzles adjacent to one another in the sheet passing direction are arranged in a staggered manner. However, a configuration is not limited to this; the cooling nozzles may be configured to be arranged in a linear manner in the sheet passing direction.

A position at which the upper surface water supplying device 21 is provided, in particular, a position at which the cooling nozzles 21*c*, 21*c*, . . . are disposed is not particularly limited; however, the upper surface water supplying device, or the cooling nozzles are preferably disposed right after the final stand 11*g* in the row 11 of hot finishing mills, from inside the housing 11*gh* of the final stand 11*g*, in a manner as closely to the work roll 11*gw* in the final stand 11*g* as possible. This arrangement enables rapid cooling of the rolled material 1 immediately after it has been rolled by the row 11 of hot finishing mills, and also enables stably guiding the top portion of the rolled material 1 to the immediate rapid-cooling device 20. In the present embodiment, as can be seen from FIG. 2, the cooling nozzles 21*c*, 21*c*, . . . close to the work roll 11*gw* are arranged closely to the rolled material 1.

Further, a direction in which the cooling water is sprayed from the cooling water ejection outlet of each of the cooling nozzles 21*c*, 21*c*, . . . is basically a vertical direction; on the other hand, the ejection of the cooling water from the cooling nozzles 21*c*, 21*c*, . . . , 22*c*, 22*c*, . . . closest to the work rolls 11*gw*, 11*gw* in the final stand 11*g* are preferably directed more toward the work rolls 11*gw*, 11*gw* than vertically. This configuration can further shorten the time period from the thickness reduction of the rolled material 1 in the final stand 11*g* to the initiation of cooling. And the recovery time of rolling strains accumulated by rolling can also be reduced to almost zero. Accordingly, it is possible to manufacture a rolled material having a finer structure.

The lower surface water supplying devices 22, 22, . . . are devices to supply cooling water to the lower surface side of the rolled material 1. The lower surface water supplying devices 22, 22, . . . comprise: cooling headers 22*a*, 22*a*, . . . ; conduits 22*b*, 22*b*, . . . , provided, in a row in a plural manner, to each of the cooling headers 22*a*, 22*a*, . . . ; and cooling nozzles 22*c*, 22*c*, . . . attached to an end portion of the conduits 22*b*, 22*b*, . . . . The lower surface water supplying devices 22, 22, . . . are arranged opposite to the above described upper surface water supplying devices 21, 21 . . . ; thus, a direction of a jet of cooling water by the lower surface water supplying device differs from that by the upper surface water supplying device. However, the lower surface water supplying devices are generally the same in structure as the upper surface water supplying devices 21, 21, . . . ; so the descriptions of the lower surface water supplying devices are omitted here.

Next, the upper surface guides 25, 25, . . . will be described. The upper surface guides 25, 25, . . . are sheet-like members arranged between the upper surface water supplying device 21 and the transported rolled material 1, in such a manner that the top portion of the rolled material 1 does not get caught by the conduits 21*b*, 21*b*, . . . and the cooling nozzles 21*c*, 21*c*, . . . at a time of passing the top portion of the rolled material 1. On the other hand, the upper surface guides 25, 25, . . . are provided with inlet holes through which to pass the jet of water from the upper surface water supplying device 21. This enables the jet of water from the upper surface water supplying device 21 to reach the upper surface of the rolled material 1 through the upper surface guides 25, 25, . . . , and enables adequate cooling. A shape of the upper surface guide 25 to be used herein is not particularly restricted; a known upper surface guide may be used.

The upper surface guides 25, 25, . . . are disposed as shown in FIG. 2. In the present embodiment, three upper surface guides 25, 25, 25 are used and are aligned in the sheet passing direction. All of the upper surface guides 25, 25, 25 are arranged so as to accord with the height of the cooling nozzles 21*c*, 21*c*, . . . . That is, in the present embodiment, the upper surface guide 25 closest to the work roll 11*gw* in the final stand 11*g* is arranged in a tilted manner that its end portion on the final stand 11*g* side is positioned lower and its end portion on the other side is positioned higher. The other two upper surface guides 25, 25 are arranged substantially in parallel with the passing sheet surface, with a predetermined spacing from the passing sheet surface.

The lower surface guide 30 is a sheet-like member arranged between the lower surface water supplying device 22 and the transported rolled material 1. This prevents the most top portion of the rolled material 1 from getting caught by the lower surface water supplying devices 22, 22, . . . and the transporting rolls 12, 12, . . . especially when passing the rolled material 1 into the manufacturing device 10. On the other hand, the lower surface guide 30 is provided with inlet holes through which to pass the jet of water from the lower surface water supplying device 22. This enables the jet of water from the lower surface water supplying device 22 to reach the lower surface of the rolled material 1 through the lower surface guide 30, and enables adequate cooling. A shape of the lower surface guide 30 to be used herein is not particularly restricted; a known lower surface guide may be used.

The lower surface guide 30 as above is disposed as shown in FIG. 2. In the present embodiment, four lower surface guides 30, 30, . . . are used and each of the lower surface guides is disposed between the transporting rolls 12, 12, 12. All of the lower surface guides 30, 30, . . . are arranged at a position which is not too low in relation to the upper end portion of the transporting rolls 12, 12, . . . .

In the present embodiment, an example in which the lower surface guide 30 is provided; however, the lower surface guide is not necessarily required.

In supplying cooling water as above, a specific water supply volume is adequately determined based on an amount of heat required to cool a rolled material; thus is not particularly limited. However, as described above, in view of refining a rolled material structure, rapid cooling immediately after rolling is effective; and for that purpose, it is preferable to supply cooling water with a high water flow density. In the above view of refining the structure of the rolled material, an example of the water flow density of cooling water per surface to be supplied may be 10 to 25 $m^3/(m^2 \cdot min)$. The water flow density may be higher than this. The cooling capability is preferably 600° C./sec or more in a 3 mm thickness rolled material.

Back to FIGS. 1 to 3, the descriptions of the manufacturing apparatus 10 will be continued. The between-stand cooling device 35 is a cooling device disposed between each of the stands in the row 11 of hot finishing mills; and comprises a between-stand upper surface water supplying device 36; a between-stand lower surface water supplying device 37; and a between-stand lower surface guide 38. Herein, the between-stand cooling device 35 which is disposed between the stand 11*f* and the final stand 11*g* is described. The between-stand cooling devices disposed between other stands also have a similar configuration.

The between-stand upper surface water supplying device 36 is a device for supplying cooling water to the upper surface side of the rolled material 1 in an area between the stands. The between-stand upper surface water supplying device 36 comprises: a cooling header 36*a*; conduits 36*b*, 36*b*, . . . provided, in a row in a plural form, to the cooling header 36*a*; and cooling nozzles 36*c*, 36*c*, . . . attached to an end portion of the conduits 36*b*, 36*b*, . . . .

The cooling header 36*a* is a pipe extending in the sheet width direction of the rolled material. The conduits 36*b*, 36*b*, . . . are formed of a plurality of thin pipes diverging from the cooling header 36*a*, and opening ends of the conduits are directed toward the upper surface side of the rolled material. A plurality of the conduits 36*b*, 36*b*, . . . are arranged in a comb-like manner along a direction of a tube length of the cooling header 36*a*, namely, in the sheet width direction of the rolled material.

An end portion of each of the conduits 36*b*, 36*b*, . . . is attached with each of the cooling nozzles 36*c*, 36*c*, . . . . The cooling nozzles 36*c*, 36*c*, . . . of the present embodiment are flat spray nozzles capable of forming a fan-like jet of cooling water (for example, a thickness of approximately 5 mm to 30 mm).

The between-stand lower surface water supplying device 37 is a device for supplying cooling water to the lower surface side of the rolled material 1. The between-stand lower surface water supplying device 37 comprises: a cooling header 37*a*; conduits 37*b*, 37*b*, . . . provided, in a row in a plural manner, to the cooling header 37*a*; and cooling nozzles 37*c*, 37*c*, . . . attached to an end portion of the conduits 37*b*, 37*b*, . . . . The between-stand lower surface water supplying device 37 is arranged opposite to the above described between-stand upper surface water supplying device 36; thus, a direction of a jet of cooling water by the between-stand lower surface water supplying device differs from that by the between-stand upper surface water supplying device. However, the between-stand lower surface water supplying device is generally the same in structure as the between-stand upper surface water supplying device; so the descriptions of the between-stand lower surface water supplying device are omitted here.

The between-stand lower surface guide 38 is a sheet-like member disposed on a lower side of the pass line where the rolled material 1 is transported; and an upper process side guide 38*a* and a lower process side guide 38*b* are disposed in the transporting direction with a predetermined spacing. In this spacing there are disposed a looper not shown in the figure, and the above described between-stand lower surface water supplying device 37. By this configuration, it is possible to appropriately guide the rolled material 1 without hindering the functions of the looper and the between-stand lower surface water supplying device.

Here, the lower process side guide 38*b* of the between-stand lower surface water supplying device 37 is provided with a hole for carrying out measurement, corresponding to the position where the below described device 40 for measuring a rolled material temperature is disposed.

The device 40 for measuring a rolled material temperature is disposed on the lower surface side of the rolled material 1 on the entry side of the final stand 11*g* in the row 11 of hot finishing mills, and measures the surface temperature (entry-side surface temperature) of the rolled material 1. The device 40 for measuring a rolled material temperature may be any kind of sensor as long as it is capable of measuring the entry-side surface temperature, thus not being restricted to any particular type.

However, in the present embodiment, taking it into account that cooling water is retained on the surface of the rolled material 1 due to the above described between-stand cooling device 35, it is preferable to reduce measurement errors attributed to the cooling water sprayed herein. Examples of a temperature measuring device capable of such measurement include a water column thermometer. As known through Japanese Patent Publication No. 3-69974, Japanese Patent Application Laid-Open Nos. 2005-24303, 2003-185501, and 2006-010130 etc., the water column thermometer is a thermometer comprising: a radiation thermometer disposed at a position opposite to the rolled material 1; and a water column forming device for forming, between the rolled material 1 and the radiation thermometer, a watercourse (water column) serving as a light waveguide. And by detecting radiation light from the surface of the rolled material 1 via this water column with the radiation thermometer, it is possible to measure the entry-side surface temperature with high precision. At this point, as described above, a hole for measuring a temperature is provided to the between-stand lower surface guide 38 which is positioned on a side where the device 40 for measuring a rolled material temperature is disposed.

Here, one device 40 for measuring a rolled material temperature may be arranged at a central position in the width direction of the rolled material 1; a plurality of the devices may be arranged in a row in the sheet width direction of the rolled material. Alternatively, a temperature measuring device (width direction thermometer) capable of measuring a temperature distribution in the sheet width direction of the rolled material 1 may also be arranged. By this, it is possible to measure the temperature distribution in this direction and to improve the precision of the temperature measurement of the rolled material 1. Further, the measurement result of the entry-side surface temperature provided by the device 40 for measuring a rolled material temperature is inputted to the below described temperature control device 50.

Figure 6:
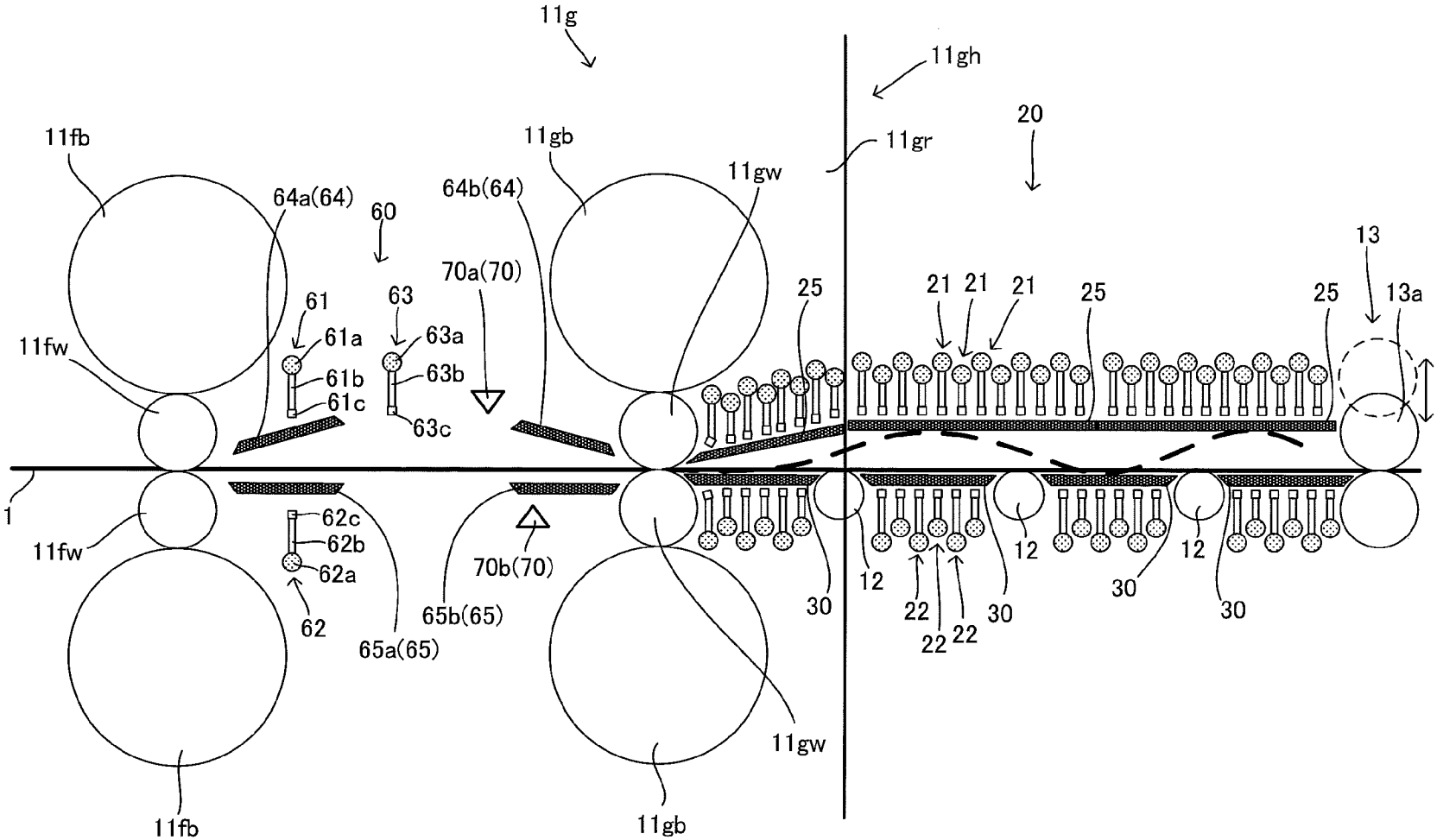
FIG. 6 is a view illustrating another example of between the final stand and the stand positioned therebefore.

FIG. 6 is a view illustrating a between-stand cooling device 60 and a device 70 for measuring a rolled material temperature in another example. Descriptions of the other components are the same as those above, and thus are omitted herein.

The between-stand cooling device 60 is a cooling device disposed between each of the stands in the row 11 of hot finishing mills; and comprises a between-stand upper surface water supplying device 61; a between-stand lower surface water supplying device 62; a side spray 63; a between-stand upper surface guide 64; and a between-stand lower surface guide 65. Herein, the between-stand cooling device 60 which is disposed between the stand 11*f* and the final stand 11*g* is described. The between-stand cooling devices disposed between other stands also have a similar configuration.

The between-stand upper surface water supplying device 61 is a device for supplying cooling water to the upper surface side of the rolled material 1 in an area between the stands. The between-stand upper surface water supplying device 61 comprises: a cooling header 61*a*; conduits 61*b*, 61*b*, . . . provided, in a row in a plural form, to the cooling header 61*a*; and cooling nozzles 61*c*, 61*c*, . . . attached to an end portion of the conduits 61*b*, 61*b*, . . . . The between-stand upper surface water supplying device 61 is the same in structure as the above described between-stand upper surface water supplying device 36; thus descriptions thereof are omitted herein.

The between-stand lower surface water supplying device 62 is a device for supplying cooling water to the lower surface side of the rolled material 1. The between-stand lower surface water supplying device 62 comprises: a cooling header 62*a*; conduits 62*b*, 62*b*, . . . provided, in a row in a plural manner, to the cooling header 62*a*; and cooling nozzles 62*c*, 62*c*, . . . attached to an end portion of the conduits 62*b*, 62*b*, . . . . The between-stand lower surface water supplying device 62 is the same in structure as the above described between-stand lower surface water supplying device 37; thus descriptions thereof are omitted herein.

The side spray 63 is a device for removing water by pushing out, in the width direction, the water retained on the upper surface side of the rolled material 1; and comprises: a header 63*a*; conduits 63*b*, 63*b*, . . . provided, in a row in a plural manner, to the header 63*a*; and nozzles 63*c*, 63*c*, . . . attached to an end portion of the conduits 63*b*, 63*b*. Here, the nozzles 63*c*, 63*c*, . . . are configured to spray water in the width direction of the rolled material 1, enabling removal of the water.

The between-stand upper surface guide 64 is a sheet-like member disposed on the upper surface side of the pass line where the rolled material 1 is transported; and an upper process side guide 64*a* and a lower process side guide 64*b* are arranged in the transporting direction with a predetermined spacing. In this spacing there are disposed the above described side spray 63 and a device 70*a* for measuring an upper surface side temperature of a rolled material of a device 70 for measuring a rolled material temperature described below. Further, the between-stand upper surface water supplying device 61 is arranged on the upper surface side of the upper process side guide 64*a* of the between-stand upper surface guide 64. Therefore, the upper process side guide 64*a* is provided with a hole through which cooling water from the between-stand upper surface water supplying device 61 penetrates.

The between-stand lower surface guide 65 is a sheet-like member disposed on the lower surface side of the pass line where the rolled material 1 is transported; and an upper process side guide 65*a* and a lower process side guide 65*b* are arranged in the transporting direction with a predetermined spacing. In this spacing there is disposed a looper not shown in the figure. Further, the between-stand lower surface water supplying device 62 is arranged on the lower surface side of the upper process side guide 65*a* of the between-stand lower surface guide 65. Therefore, the upper process side guide 65*a* is provided with a hole through which cooling water from the between-stand lower surface water supplying device 62 penetrates. Here, on the lower surface side of the lower process side guide 65*b* of the between-stand lower surface guide 65 there is disposed a device 70*b* for measuring a lower surface side temperature of a rolled material of the device 70 for measuring a rolled material temperature. Therefore, the lower process side guide 65*b* is provided with a hole for measurement, corresponding to the position where the device 70*b* for measuring a lower surface side temperature of a rolled material is disposed.

The device 70 for measuring a rolled material temperature comprises the device 70*a* for measuring an upper surface side temperature of a rolled material and the device 70*b* for measuring a lower surface side temperature of a rolled material. The device 70*a* for measuring an upper surface side temperature of a rolled material is disposed in the gap between the between-stand upper surface guides 64, as described above; and measures the upper side surface temperature of the rolled material 1 on the entry side of the final stand 11*g* in the row 11 of hot finishing mills. Here, in the present configuration, the water remaining on the upper surface of the rolled material 1 has been removed by the side spray 63; therefore, as to the device 70*a* for measuring an upper surface side temperature of a rolled material, an ordinary temperature measuring sensor may be applied without considering cooling water. One device 70*a* for measuring an upper surface side temperature of a rolled material may be arranged at a central position in the width direction of the rolled material 1; a width direction thermometer which is capable of measuring the temperature of the entire width of the rolled material may be arranged. By using the width direction thermometer, it is possible to measure a temperature distribution in the width direction, and to improve the precision of the temperature measurement of the rolled material. Alternatively, a plurality of thermometers may be arranged in a row in the width direction. This also produces the same effects as those by the width direction thermometer.

On the other hand, the device 70*b* for measuring a lower surface side temperature of a rolled material shares characteristics in common with the above device 40 for measuring a rolled material temperature described in FIG. 2; thus the descriptions thereof are omitted.

Back to FIG. 1, the descriptions of the manufacturing apparatus 10 will be continued. The coilbox 15 is equipment for once coiling a rolled material (rough bar) after rough rolling. This enables inhibition of the temperature decline of the rough bar. Herein, a known coilbox may be used, and the type thereof is not particularly restricted.

The rough bar heater 16 is a device for heating to a required temperature, the rough bar returned from the coilbox 15. That is, the temperature of the rough bar is increased to a predetermined temperature, over the entire sheet width direction of the rolled material by a method such as induction heating, gas burning heating, and energization heating. As to the rough bar heater, a known one may be applied. The type thereof is not particularly restricted; however, the induction heating method is preferred since the gas burning heating method has low combustion efficiency and the energization heating method tends to cause defects. Examples of the induction heating method may include solenoidal coil heating method (axial flux heating) and transverse heating method (transverse flux heating)

The descaler 17 is equipment for removing scales (i.e. deposited substances and unnecessary product materials) generated on both surfaces of the rolled material. In specific, high-pressure water is sprayed at both surfaces of the rolled material, thereby removing the scales with the impact force thereof.

The temperature control device 50 comprises a target temperature arithmetic device 51 and a equipment control device 52.

The target temperature arithmetic device 51 is a device for calculating the entry-side target surface temperature from the target temperature on the exit side of the final stand 11*g* (exit-side target surface temperature) by taking into account each of the temperature increases and decreases, the entry-side target surface temperature being the surface temperature of the rolled material desired on the entry side of the final stand 11*g*. The detailed descriptions of the calculation performed herein will be given later.

The equipment control device 52 judges whether the entry-side target surface temperature obtained from the target temperature arithmetic device 51 matches the measured entry-side surface temperature obtained from the device 40 for measuring a rolled material temperature; and if the temperatures do not match, the equipment control device 52 controls at least one of the coilbox 15, rough bar heater 16, descaler 17, and between-stand cooling device 35.

With the manufacturing apparatus 10 comprising the above configuration, even when a cooling device capable of cooling from inside the row 11 of hot finishing mills is disposed on the exit side of the row 11 of hot finishing mills, it is possible to provide a target temperature of the rolled material 1 on the entry side of the final stand in the row 11 of hot finishing mills. Further, by comprising a means for controlling a device based thereon, it is possible to control the temperature of the rolled material 1.

Next, an example of a method for manufacturing a hot-rolled steel sheet by using the manufacturing apparatus 10 will be described.

First, the entry-side target surface temperature, which is the targeted temperature on the entry side of the final stand 11*g* in the row 11 of hot finishing mills, is calculated by the target temperature arithmetic device 51 of the temperature control device 50. In specific, the entry-side target surface temperature on the entry side of the final stand 11*g* (the device for measuring a rolled material temperature) is calculated, before rolling, from the prescribed target temperature on the exit side of the final stand 11*g* (exit-side target surface temperature), by taking into consideration a temperature increase by a heat generated by rolling processing in the final stand 11*g*; a temperature reduction by contact of the work rolls 11*gw*, 11*gw* with the rolled material 1; and the cooling temperature reduction by air cooling associated with transporting and by water cooling from the position of the final stand 11*g* in which position the device 40 for measuring a rolled material temperature is disposed to the final stand 11*g*. For example, the following arithmetic expression may be employed in calculating this entry-side target surface temperature.

A temperature increase $\Delta T_1$ by a heat generated by rolling processing in the final stand 11*g* is represented by Formula 1.

[Formula 1]

$$\Delta T_1 = \frac{2}{c\rho h_2}\frac{\eta G}{wr} \tag{1}$$

Herein, c represents a specific heat (J/kg·K) of the rolled material 1. ρ represents a density (kg/m$^3$) of the rolled material 1. ηrepresents a heat processing efficiency. G represents a roll torque (N·m). Additionally, r represents a diameter (m) of the work roll. w represents a sheet width (m) of the rolled material. $h_2$ represents a sheet thickness (m) after the final stand 11*g*.

Further, a temperature reduction $\Delta T_2$ by contact with the work rolls 11*gw*, 11*gw* can be calculated by Formula 2.

[Formula 2]

$$\Delta T_2 = \frac{2}{c\rho h_2}\sqrt{\frac{\lambda c\rho t_R}{\pi}}\,(T_{S2} - T_R) \tag{2}$$

Herein, c represents a specific heat (J/kg·K) of the rolled material 1. ρ represents a density (kg/m$^3$) of the rolled material 1. λ represents a thermal conductivity (W/m·K) of the rolled material 1. Further, $h_2$ represents a sheet thickness (m) after the final stand 11*g*. $t_R$ represents the time (sec.) during which the rolled material 1 is in contact with the work rolls 11*gw*, 11*gw* of the final stand 11*g*. $T_{S2}$ represents a surface temperature (° C.) of the rolled material 1 during contact with the work rolls 11*gw*, 11*gw*. $T_R$ represents a temperature of the work rolls 11*gw*, 11*gw*.

Furthermore, cooling temperature reductions by air cooling and water cooling in the transportation from the device 40 for measuring a rolled material temperature to the work rolls 11*gw*, 11*gw* can be determined by Formulas 3 and 4. Formula 3 represents a temperature reduction $\Delta T_{3A}$ by air cooling. Formula 4 represents a temperature reduction $\Delta T_{3L}$ by water cooling.

[Formula 3]

$$\Delta T_{3A} = \frac{2\sigma\varepsilon}{c\rho h_1}\left\{\left(\frac{T_{S3A}+273}{100}\right)^4 - \left(\frac{T_A+273}{100}\right)^4\right\}t_{3A} + \frac{2\alpha_A}{c\rho h_1}(T_{S3A} - T_A)t_{3A} \tag{3}$$

[Formula 4]

$$\Delta T_{3L} = \frac{2\alpha_R}{c\rho h_2}(T_{S3L} - T_L)t_{3L} \tag{4}$$

Herein, σ represents Stefan-Boltzmann's constant (W/m$^2$·K$^4$). ϵ represents an emissivity (–) of the rolled material 1. c represents a specific heat (J/kg·K) of the rolled material 1. ρ represents a density (kg/m$^3$) of the rolled material 1. Further, $\alpha_A$ represents a heat transfer coefficient (W/m$^2$·K) in an air-cooling area. $\alpha_R$ represents a heat transfer coefficient (W/m$^2$·° C.) by water cooling. $h_2$ represents a sheet thickness (m) after the final stand 11*g*. $T_{S3L}$, represents a surface temperature (° C.) of the rolled material 1 in the water-cooling area. $T_{S3A}$ represents a surface temperature (° C.) of the rolled material 1 in the air-cooling area. $T_A$ represents an air temperature (° C.). $T_L$, represents a temperature of cooling water. $t_{3L}$ represents the time (sec.) for passing through the water-cooling area. $t_{4A}$ represents the time (sec.) for passing through the air-cooling area. Here, the surface temperature of the rolled material 1 in the water-cooling area means an average temperature in the water-cooling area.

The target temperature arithmetic device 51 sends thus calculated entry-side target surface temperature (target temperature on the entry side of the final stand 11*g* in the row 11 of hot finishing mills) to the equipment control device 52.

It should be noted that the target temperature on the entry side of the final stand 11*g* in the present invention is ideally calculated based on various input conditions automatically every time before rolling. However, in order to reduce burdens on a calculator, a method may be employed in which the target temperature predetermined offline is prepared in a table and values of similar conditions are referred to in the table before rolling. Needless to say, in determining the target temperature offline, the influences of the heat generated by rolling processing in the final stand and of the temperature reductions caused by the air cooling by transporting and the contact with the work rolls 11*gw*, 11*gw*, are taken into account.

Next, the equipment control device 52 compares the received entry-side target surface temperature and the received entry-side surface temperature measured by the device 40 for measuring a rolled material temperature. When the entry-side target surface temperature matches the measured entry-side surface temperature in this comparison, no commands are sent in order to maintain this state. On the other hand, when the temperatures do not match, a command is sent to at least one of the coilbox 15, rough bar heater 16, descaler 17, and between-stand cooling device 35; and in the command, it is ordered that the conditions be modified such that the entry-side surface temperature measured by the device 40 for measuring a rolled material temperature matches the entry-side target surface temperature. That is, when the entry-side surface temperature measured by the device 40 for measuring a rolled material temperature is lower than the entry-side target surface temperature, a command to suppress cooling is given; and when it is higher than the entry-side target surface temperature, a command to strengthen cooling is given.

In specific, a command given to the coilbox 15 may be modification of the retention time; a command given to the rough bar heater 16 may be modification of the heating temperature; and a command given to the descaler 17 may be modification of the volume of sprayed water or the spraying time.

Herein, at a time of carrying out rolling constantly without changing the rolling reduction during rolling, the temperature is calculated on the supposition that the sheet thickness and the friction coefficient (an influence by a rolling lubricant oil) in each stand 11*a*, . . . 11*f*, 11*g* of the row 11 of hot finishing mills are constant in the longitudinal direction of the rolled material.

On the other hand, at a time of changing the rolling reduction during rolling, it is necessary to change the sheet thickness and the friction coefficient in each stand 11*a*, . . . 11*f*, 11*g* of the row 11 of hot finishing mills, in the longitudinal direction of the coil. Therefore, in calculating the entry-side target surface temperature as well, the information on the designated sheet thickness and rolling lubricant oil (friction coefficient) in the longitudinal direction of the coil is taken into account.

In specific, changing the rolling reduction during rolling may be carried out in the following way. Operational control of the row of hot finishing mills for changing the rolling reduction during rolling comprises a step of determining an exit-side sheet thickness (hereinafter sometimes referred to as a "step S1"); and the step S1 comprises a step of determining a first exit-side sheet thickness (hereinafter sometimes referred to as a "step S11") and a step of determining a second exit-side sheet thickness (hereinafter sometimes referred to as a "step S12"). That is, in the operational control, the step S1 comprising the step S11 and the step S12 is employed to control the operation of the row of hot finishing mills.

<Step of Determining an Exit-Side Sheet Thickness: S1>

The step S1 is a step of determining each sheet thickness on the exit side of each of the stands from the first stand to the Nth stand (N being a whole number of two or more). In specific, in a case of N=7 and m=3 (m being a whole number of one or more and N or less), the step S1 is a step of determining each sheet thickness on the exit side of the seven stands from the first stand 11*a* to the seventh stand 11*g*. In the operation control method of the present mode, the mode is not particularly restricted as long as the step S1 comprises the below described step S11 and the step S12.

<Step of Determining a First Exit-Side Sheet Thickness: S11>

The step S11 is a step of determining the sheet thicknesses on the exit sides of the stands from the first stand to the Nth stand at a time of rolling a steady portion of the rolled material 1. In specific, in a case of N=7, the step S11 is a step of determining the sheet thicknesses H1 to H7 on the exit sides of the stands from the first stand 11*a* to the seventh stand 11*g* at a time of rolling the steady portion of the rolled material 1. In this operational control, the steady portion of the rolled material 1 refers to a portion of the rolled material 1 which portion is rolled with a rolling lubricant and is rolled under the rolling conditions for attaining intended specifications (sheet thickness, particles size) of a product <Step of Determining a Second Exit-Side Sheet Thickness: S12>

The step S12 is a step of determining the sheet thicknesses on the exit sides of the stands from the first stand to the Nth stand such that the sheet thickness on the exit side of each of the later-stage stands from the N-m+1 stand to the Nth stand at a time of rolling the top portion to be rolled of the rolled material 1 becomes larger than the sheet thickness on the exit side of the same stands at a time of rolling the steady portion of the rolled material 1. That is, in a case of N=7 and m=3, the step S12 is a step of determining each of the sheet thicknesses H1' to H7' on the exit side of each of the stands from the first stand 11*a* to the seventh stand 11*g*, such that when the sheet thicknesses on the exit sides of each of the later-stage stands from the fifth stand 11*e* to the seventh stand 11*g*, the sheet thicknesses being determined in the step S12, are respectively defined as H5', H6', and H7', the relations: H5'>H5; H6'>H6; and H7'>H7 are satisfied. In the operation control method of the present mode, the top portion to be rolled of the rolled material 1 refers to the portion on the top side of the rolled material which portion is rolled without using the rolling lubricant.

Here, the row 11 of hot finishing mills (comprising seven stands in total) which rolls the rolled material 1 is operated in the following way. First, the rolling is started such that the sheet thicknesses on the exit sides of the stands from the first stand 11*a* to the seventh stand 11*g* become the exit-side sheet thicknesses H1' to H7' of the top portion to be rolled, determined in the step S12. At this time, the rolling lubricant is not supplied. At a certain timing after the most top portion of the rolled material enters into the row of hot finishing mills, the rolling lubricant starts to be supplied in the fifth stand 11*e* to the seventh stand 11*g*; and the rolling mills are operated such that the sheet thicknesses on the exit sides of the stands from the first stand lie to the seventh stand 11*g* become the exit-side sheet thicknesses H1 to H7 of the steady portion, determined in the step S11, then moving on to rolling of the steady portion.

The sheet thickness and friction coefficient in each stand 11*a*, . . . , 11*f*, 11*g* of the row 11 of hot finishing mills operated in this manner are changed in the longitudinal direction of the coil, the changes being sequentially applied to the target temperature calculation to thereby calculate the target temperature.

By the above manufacturing method of a hot-rolled steel sheet using the manufacturing apparatus 10, it is possible to set a target temperature on the entry side of the final stand 11*gw* in the row 11 of hot finishing mills. And by comparing the target temperature with the actual temperature and giving a command to the equipment, it is possible to control the temperature of the rolled material 1.

Figure 7:
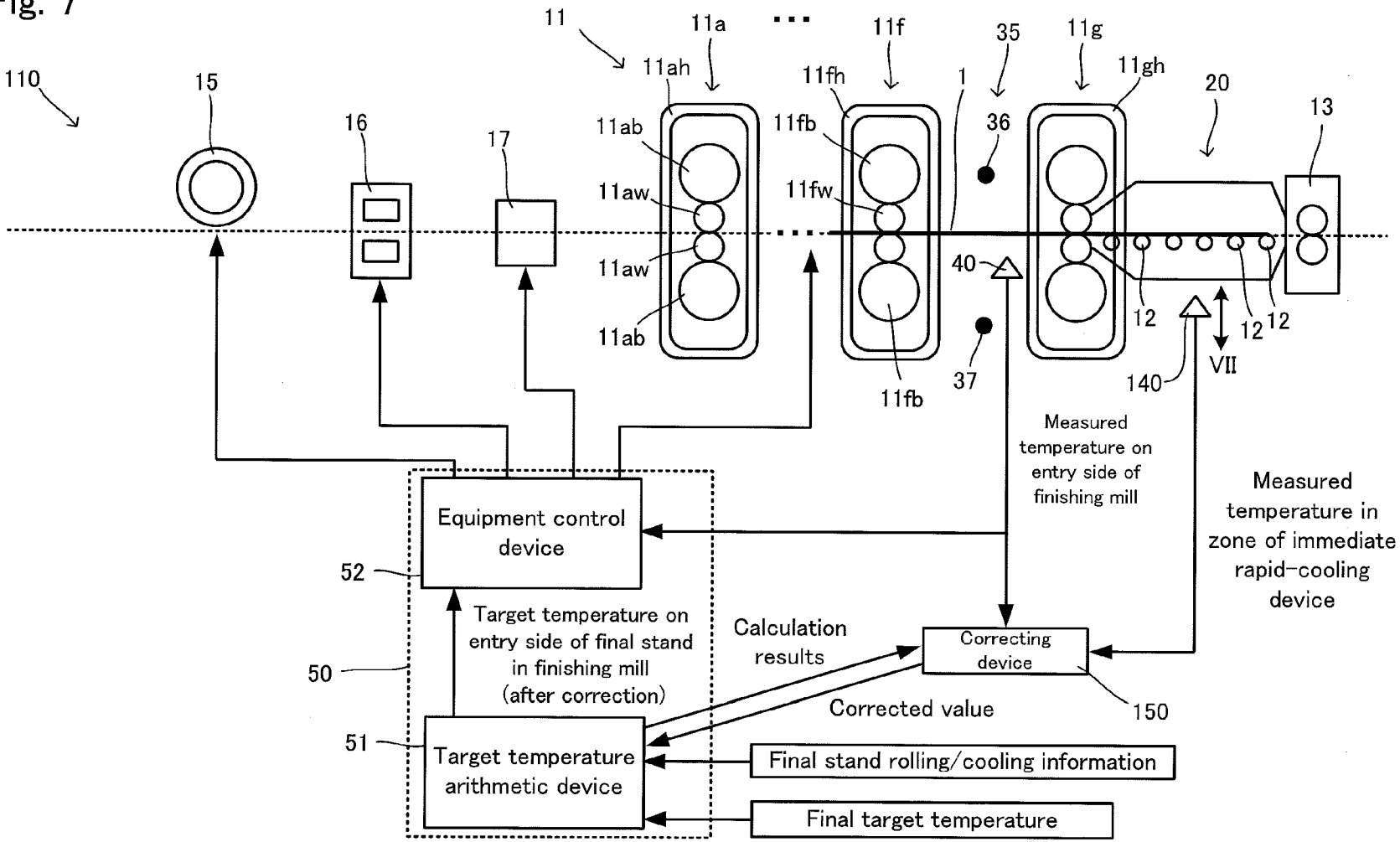
FIG. 7 is a schematic view showing a part of a manufacturing apparatus of a hot-rolled steel sheet according to a second embodiment.

FIG. 7 is a conceptual view illustrating a manufacturing apparatus 110 of a hot-rolled steel sheet (hereinafter, sometimes referred to as a "manufacturing apparatus 110"), in accordance with a second embodiment. The manufacturing apparatus 110 differs from the manufacturing apparatus 10 in that the manufacturing apparatus 110 comprises a device 140 for measuring a rolled material temperature after rolling, and a correction device 150. The other components are the same as those of the manufacturing apparatus 10; thus the same symbols are used in FIG. 7, and the descriptions thereof are omitted.

The device 140 for measuring a rolled material temperature after rolling is a temperature measuring device which can be moved in a direction shown by the Arrow VII in FIG. 7. The device 140 for measuring a rolled material temperature after rolling moves close to the rolled material 1 at a time of rolling not using the immediate rapid-cooling device 20; measures the temperature of the rolled material; and moves back when the immediate rapid-cooling device 20 is used. This can distinguish between the time of using the immediate rapid-cooling device 20 and the time of not using the immediate rapid-cooling device 20, enabling more appropriate temperature control of the rolled material 1.

The correction device 150 is a device which takes in the temperature information from the device 40 for measuring a rolled material temperature and the device 140 for measuring a rolled material temperature after rolling, to carry out a calculation, and sends the results to the target temperature arithmetic device 51, in a case when the immediate rapid-cooling device 20 is not used and the device 140 for measuring a rolled material temperature after rolling is used.

The correction device 150 takes into account the difference between the device 40 for measuring a rolled material temperature and the device 140 for measuring a rolled material temperature after rolling, and the temperature drop by the heat release between both of these sensors, thereby obtaining the predicted value of the temperature on the exit side of the final stand 11*g*.

On the other hand, the target temperature arithmetic device 51 sends the correction device 150 the calculated temperature on the exit side of the final stand 11*g* obtained in the calculation process of the target surface temperature performed by the device 51.

The correction device 150 compares these predicted value and calculated temperature; corrects the calculation errors; and sends the correction to the target temperature arithmetic device 51. And the target temperature arithmetic device 51 calculates, by the corrected arithmetic expression, the target temperature on the entry side of the final stand 11*g* in the row 11 of hot finishing mills (entry-side target surface temperature); and sends the results to the equipment control device 52.

This enables improvement of calculation precision of the target temperature on the entry side of the final stand 11*g* in the row 11 of hot finishing mills (entry-side target surface temperature).

The invention has been described above as to the embodiment which is supposed to be practical as well as preferable at present. However, it should be understood that the invention is not limited to the embodiment disclosed in the specification and can be appropriately modified within the range that does not depart from the gist or spirit of the invention, which can be read from the appended claims and the overall specification, and a manufacturing method of a hot-rolled steel sheet and a manufacturing apparatus of a hot-rolled steel sheet with such modifications are also encompassed within the technical range of the invention.

DESCRIPTION OF THE SYMBOLS

1 rolled material
10 manufacturing apparatus of hot-rolled steel sheet
11 row of hot finishing mills
12 transporting roll
13 pinch roller
14 coiling device
15 coilbox
16 rough bar heater
17 descaler
20 immediate rapid-cooling device
21 upper surface water supplying device
22 lower surface water supplying device
25 upper surface guide
30 lower surface guide
35 between-stand cooling device
36 between-stand upper surface water supplying device
37 between-stand lower surface water supplying device
38 between-stand lower surface guide
40 device for measuring rolled material temperature
50 temperature control device
51 target temperature arithmetic device
52 equipment control device
110 manufacturing apparatus of hot-rolled steel sheet
140 device for measuring rolled material temperature after rolling

The invention claimed is:

1. A manufacturing method of a hot-rolled steel sheet, wherein cooling water is sprayed at an inside of a housing of a final stand on a lower process side of the final stand, which is disposed on an end on the lower process side in a row of hot finishing mills, to rapidly cool a rolled material;

a surface temperature of the rolled material is measured on an entry side of the final stand, to obtain an entry-side surface temperature; and an entry-side target surface temperature, which is a target surface temperature of the rolled material at the measurement position of the entry-side surface temperature, is calculated from an exit-side target surface temperature, which is a target surface temperature of the rolled material on an exit side of the final stand, based on: a temperature increase by a heat generated by rolling processing in the final stand; a temperature reduction by contact of a work roll in the final stand with the rolled material; and a temperature reduction by air cooling in transportation from the measurement position of the entry-side surface temperature to the work roll of the final stand.

2. The manufacturing method of a hot-rolled steel sheet according to claim 1, wherein in calculating the entry-side target surface temperature, changes in the surface temperature of the rolled material in a rolling direction are included as an element.

3. The manufacturing method of a hot-rolled steel sheet according to claim 1, wherein in a case when rolling by the row of hot finishing mills is carried out by a rolling method to change a rolling reduction of the rolling mills during the rolling, sheet thickness changes and changes in a friction coefficient between the rolled material and the work roll due to the rolling reduction changes are also included as elements in calculating the entry-side target surface temperature.

4. The manufacturing method of a hot-rolled steel sheet according to claim 1, wherein the rolled material is cooled by cooling water also in the entry side of the final stand; and in calculating the entry-side target surface temperature, the temperature reduction by water cooling at a time of transportation from the measurement position of the entry-side surface temperature to the work roll of the final stand is also included as an element.

5. The manufacturing method of a hot rolled steel sheet according claim 1, wherein a measuring device of the entry-side surface temperature is a thermometer disposed at a position opposing to the surface of the rolled material; and as to the thermometer, a plurality of the thermometers are disposed in a sheet width direction of the rolled material, or one width direction thermometer is disposed.

6. The manufacturing method of a hot-rolled steel sheet according to claim 1, wherein the measuring device of the entry-side surface temperature is a water column thermometer comprising: a radiation thermometer disposed at the position opposing to the surface of the rolled material; and a water column forming device for forming a watercourse as a light waveguide between the rolled material and the radiation thermometer.

7. The manufacturing method of a hot-rolled steel sheet according to claim 1, wherein the entry-side target surface temperature and the entry-side surface temperature are compared based on the calculated entry-side target surface temperature and the measured entry-side surface temperature; and a command is sent to at least one of a coilbox, rough bar heater, descaler, and between-stand cooling device such that the entry-side surface temperature becomes the entry-side target surface temperature.

8. The manufacturing method of a hot-rolled steel sheet according to claim 1, wherein when rolling is carried out without performing the rapid cooling, a surface temperature of the rolled material is measured in a zone supposed to be rapidly coolable or immediately after the zone to obtain a post-rolling surface temperature, wherein a surface temperature of the rolled material on the exit side of the final stand is calculated based on the measured entry-side surface temperature and the post-rolling surface temperature; the calculated surface temperature is compared with a surface temperature of the rolled material on the exit side of the final stand obtained by a calculation process of the entry-side target surface temperature; and the calculation of the entry-side target surface temperature when performing the rapid cooling is modified based on an error.

9. The manufacturing method of a hot rolled steel sheet according to claim 1, wherein water flow density of the cooling water is 10 $m^3/(m^2 \cdot min)$ or more.

10. A manufacturing method of a hot-rolled steel sheet, wherein cooling water is sprayed at an inside of a housing of a final stand on a lower process side of the final stand, which is disposed on an end on the lower process side in a row of hot finishing mills, to rapidly cool a rolled material;

a surface temperature of the rolled material is measured on an entry side of the final stand, to obtain an entry-side surface temperature;

a prescribed entry-side target surface temperature and the measured entry-side surface temperature are compared; and a command is sent to at least one of a coilbox, rough bar heater, descaler, and between-stand cooling device such that the measured entry-side surface temperature becomes the entry-side target surface temperature.

11. The manufacturing method of a hot rolled steel sheet according to claim 10, wherein water flow density of the cooling water is 10 $m^3/(m^2 \cdot min)$ or more.

* * * * *